US005322016A

United States Patent [19]

Toth

[11] Patent Number: 5,322,016

[45] Date of Patent: Jun. 21, 1994

[54] METHOD FOR INCREASING THE PROBABILITY OF SUCCESS OF AIR DEFENSE BY MEANS OF A REMOTELY FRAGMENTABLE PROJECTILE

[75] Inventor: Peter Toth, Kloten, Switzerland

[73] Assignee: Oerlikon-Contraves AG, Zurich, Switzerland

[21] Appl. No.: 984,954

[22] Filed: Dec. 2, 1992

[30] Foreign Application Priority Data

Dec. 18, 1991 [CH] Switzerland ..... 03755/91

[51] Int. Cl.[5] ..... F42C 13/00

[52] U.S. Cl. ..... 102/211

[58] Field of Search ..... 102/200, 211, 214, 506, 102/492, 475

[56] References Cited

U.S. PATENT DOCUMENTS

| | | | |
|---|---|---|---|
| 3,844,217 | 10/1974 | Ziemba | 102/70.2 R |
| 3,955,069 | 5/1976 | Ziemba | 235/92 PE |
| 4,168,663 | 9/1979 | Kohler | 102/214 |
| 4,267,776 | 5/1981 | Eickerman | 102/215 |
| 4,625,647 | 12/1986 | Laures | 102/214 |
| 4,895,075 | 1/1990 | Münzel | 102/214 |
| 4,899,661 | 2/1990 | Kaelin | 102/491 |

FOREIGN PATENT DOCUMENTS

| | | | |
|---|---|---|---|
| 0161962 | 11/1985 | European Pat. Off. | F42C 13/00 |
| 0309734 | 4/1989 | European Pat. Off. | F42C 13/04 |
| 2348365 | 4/1974 | Fed. Rep. of Germany | F42C 11/06 |
| 3123339 | 12/1982 | Fed. Rep. of Germany | F42C 13/00 |

OTHER PUBLICATIONS

H. A. Bulgerin, "Command Detonate Fuze", *Navy Technical Bulletin*, vol. 2, No. 2, published Feb. 1977, pp. 1–4.

*Primary Examiner*—Ian J. Lobo

*Attorney, Agent, or Firm*—Sandler Greenblum & Bernstein

[57] ABSTRACT

A weapons system with at least one fire control device and a launcher uses a remotely fragmentable projectile for defense against a missile or other movable target. Although the probability of a hit is increased with the use of a remotely fragmentable projectile, the system of the invention increases the success of the defense, which is nevertheless questionable because of the low density of the projectile fragments. The method utilizes a projectile, the fragments of which are concentrated in a ring, which spreads out in the shape of a conical envelope. The projectile is individualized at launch. Tracking of the target continues during the flight of the projectile, because of which the expected location at the pre-calculated time of impact becomes continuously better known. The fragmentation command is transmitted to the projectile as late as possible. It is always possible with a high degree of probability to score a hit. An increased chance of success of the defense is the result of the relatively great density of the fragments concentrated in the ring.

4 Claims, 4 Drawing Sheets

METHOD FOR INCREASING THE PROBABILITY OF SUCCESS OF AIR DEFENSE BY MEANS OF A REMOTELY FRAGMENTABLE PROJECTILE

BACKGROUND OF THE INVENTION

1. Field of the Invention

The present invention relates to the field of air defense against missiles, e.g., by means of projectiles and relates to a method for increasing the probability of success by means of an intended fragmentation of a specially designed projectile.

2. Description of Background and Material Information

Missiles are unmanned aerial objects, such as rockets, guided bombs, projectiles and drones. The spectrum of possible movements of such objects is greatly varied. The means for defense against them are correspondingly varied; they extend from simple air defense launchers to complex air-to-air weapons with target-seeking heads. Installations for defending against and destroying enemy missiles by means of projectiles, which are the subject of this application, essentially include at least one launching tube or gun for launching the projectile and a fire control device for measuring the movement of the missile and calculating the launching direction and the time for triggering. Automatic fire control is indispensable for defense against fast and maneuverable missiles, i.e., tracking of the target, in the case of a missile, and calculation of the launching direction takes place continuously on the basis of the results of the tracking, and guidance of the gun is continuously readjusted. If desired, the timing and the lenqth of the salvo can also take place automatically, once the inhibition of the launching command has been removed.

The general problem of aircraft or missile defense consists in bringing a sufficiently large destructive potential at the right time to the instantaneous position of the object to be combatted and to make it become effective there. In the simplest instance, the destructive potential consists in the moved mass of a ballistic projectile, i.e., in kinetic energy. So that it can become effective, the projectile or at least a portion of it must hit the target. Another possibility is an explosive projectile which carries explosive matter, i.e., latent chemical energy, which detonates in case of a direct hit or with the aid of a proximity fuse, and has its destructive effect in heat radiation and pressure waves.

However, the defense task consists in rendering the object harmless, i.e., to destroy it, to steer it away from its dangerous course or to damage it in such a way that it can no longer fulfill its purpose. In this connection, it does obviously make a difference where the object is hit (or at what distance from the object the charge detonates) and how the destructive energy is transmitted. Although a clean shot through a stabilizer is a hit, it remains without effect, the same as an exactly placed load of the smallest shot pellets, none of which is able to penetrate the hull of the object.

The design of the munitions and consideration of the probabilities of destruction of the object for various impact positions must be included in missile defense calculations. However, the initial point of departure is that the impact problem of the defense is basically solved if:

from the target tracking until the firing of the projectile, the target trajectory during the flight time of the projectile is known;

the trajectory of the projectile with respect to a set direction of departure is known from the knowledge of ballistics;

the guidance data for the gun for scoring a hit are known from the fire control calculations on the basis of the above information, and after launch, the expected meeting point between projectile and target in space and the time of the impact are known.

However, in actuality the target and projectile will hardly meet at the calculated place. Calculations are based on extrapolations which naturally include uncertainties. The uncertainty regarding the position of the projectile at the calculated time of the impact results from aiming errors and the spread or range of the gun, the spread or range of the initial velocity of the projectile and external ballistic disturbances, for example the effect of wind. The uncertainty regarding the position of the target at the calculated time of the impact results from the limited measuring accuracy during target tracking, the inherent variance of the prediction algorithm and the maneuvers of the target not detected in the meantime. Thus there is the problem of an insufficient hit and destruction probability on account of these uncertainties, in short, the unsatisfactory probability of success of the missile defense, which needs to be improved by suitable means.

A known measure for increasing the probability of success consists in time-imprinting of the projectile. Immediately at the time of launching, the projectile is time-imprinted, i.e., it is imprinted with a time after which it causes its detonating or fragmenting. Such a projectile is effective because of the fragments or the pressure wave of the explosives, which are distributed in space within a conical area. The time of fragmentation is chosen to be such that the fragments or the pressure waves cover the area of uncertainty of the position of the target at the calculated impact time. The imprinted time is the calculated flight time of the projectile to the ideal impact point, less the lead time. The latter can be constant or can be optimally calculated on the basis of the conditions at the time.

The described method has the disadvantage that the available destructive potential must be distributed over the relatively large range of the target uncertainty area, which reduces the effect of a hit. An improvement in this respect is achieved by means of a projectile with a proximity fuse. In general, this is adapted to the relative velocity between the target and the projectile, which is determined by Doppler measurements. Detonating takes place when the relative velocity value, which decreases in proximity to the target, falls below a preset value. A direct hit is not preempted by this. As a rule, fragmentation of the projectile takes place closer to the object than with the time-imprinting method, which results in a higher probability of destruction. However, the proximity fuse requires measuring and signal processing on- board the projectile.

Another possibility of improvement consists in programming the projectile in flight. After launching, determination of the position of the target is continued. Because of this the location of the target can be determined with increasing accuracy until the calculated time of impact. From this it is possible in turn to derive the optimum time-imprinting. If the projectile is equipped with a receiving device and is designed in such a way that at launch it is not only time-imprinted with a mean value, but can also be individually set, it is possible to inform every single projectile in flight at what time it is to fragment. German Patent Publication No. 2,348,365 describes a weapons system which can affect the fuse of a projectile in flight. It comprises a pulse transmitter which can send data to the fuse in the projectile via a transmitting antenna. Among other things, the fuse in the projectile has an electronic receiving device for these data. The data contain the individual address, so that only a particular fuse is addressed, and correction values for a running counter. Detonation takes place when a particular count has been reached. By correcting the count, it is therefore possible to advance or retard the detonation time. Thus, this method results in a reduced target uncertainty zone and an adapted time advance. However, if it arises that the target and the projectile will cross at a relatively large distance, there is nothing else to do but to have the projectile fragment early so that fragments reach the vicinity of the target at all. The destructive potential of these few fragments will hardly suffice to render the target harmless.

SUMMARY OF THE INVENTION

It is therefore an object of the invention to find a method which increases the probability of success for repulsing a missile by means of a fragmentation projectile.

This object is obtained by means of a method by which target tracking is continued by means of a fire control device following the launch of the projectile and in this way the position of the target at the expected time of impact is determined with increasing accuracy. A projectile is used, the fragment parts of which tend to move apart in the shape of a conical envelope with approximately equal radial velocity on a widening ring after fragmentation, and the time of fragmentation is selected to be such that a spatial and temporal meeting of the target at a point on the ring of the projectile fragments is the result. By way of example, reference can be made to U.S. Pat. No. 4,899,661, the disclosure of which is hereby incorporated by reference in its entirety for the purpose of disclosing a particular type of projectile. Such projectile could be detonated by means of a remotely actuated fuse or detonator.

In accordance with a preferred embodiment of the invention, the projectile fragments are evenly distributed on the widening ring.

Still further in accordance with another aspect of the present invention, the deviation values of the projectile departure are measured at the launch of the projectile, from which the expected location of the projectile at the expected time of impact is more accurately determined and included in the calculation of the time of fragmentation.

Additionally, according to another aspect of the present invention, the initial velocity of the projectile is measured as a deviation value and is included in the calculation.

In a further aspect of the present invention, the aiming error of the launcher is measured as a deviation value and is included in the calculation.

In a still further aspect of the present invention, the projectile is tracked in flight after launch and from this the location of the projectile at the expected impact time is increasingly more accurately determined.

The method of the invention is based on a projectile, the fragments of which during fragmentation are concentrated in a conical envelope. Following launching of the projectile, tracking of the target continues. The location of the target now becomes known with greater accuracy of the time approaches the pre-calculated impact time. In general, it will not agree with the one originally calculated. The fragmentation command is issued to the projectile in flight as late as possible. The point of fragmentation is selected to be such that the fragments diverging within the envelope of the cone impact the target on the new actual target track. In this way the projectile fragmentation acts like a one-time change in the projectile track by one-half of the opening angle of the cone for a portion of the mass of the projectile. This has the great advantage that the available destruction potential remains more strongly concentrated than with customary time-imprinted projectiles and those having a proximity fuse. Active tracking of the target from the projectile, such as is imperative in case of the latter, is not necessary.

BRIEF DESCRIPTION OF THE DRAWINGS

The above and additional objects, characteristics, and advantages of the present invention will become apparent in the following detailed description of a preferred embodiment, with reference to the accompanying drawings which are presented as non-limiting examples, in which.

DETAILED DESCRIPTION OF THE PREFERRED EMBODIMENTS

With respect to the drawings, only enough of the arrangement of the invention has been depicted, to simplify the illustration, as needed for those of ordinary skill in the art to readily understand the underlying principles and concepts of the present invention.

Figure 1:
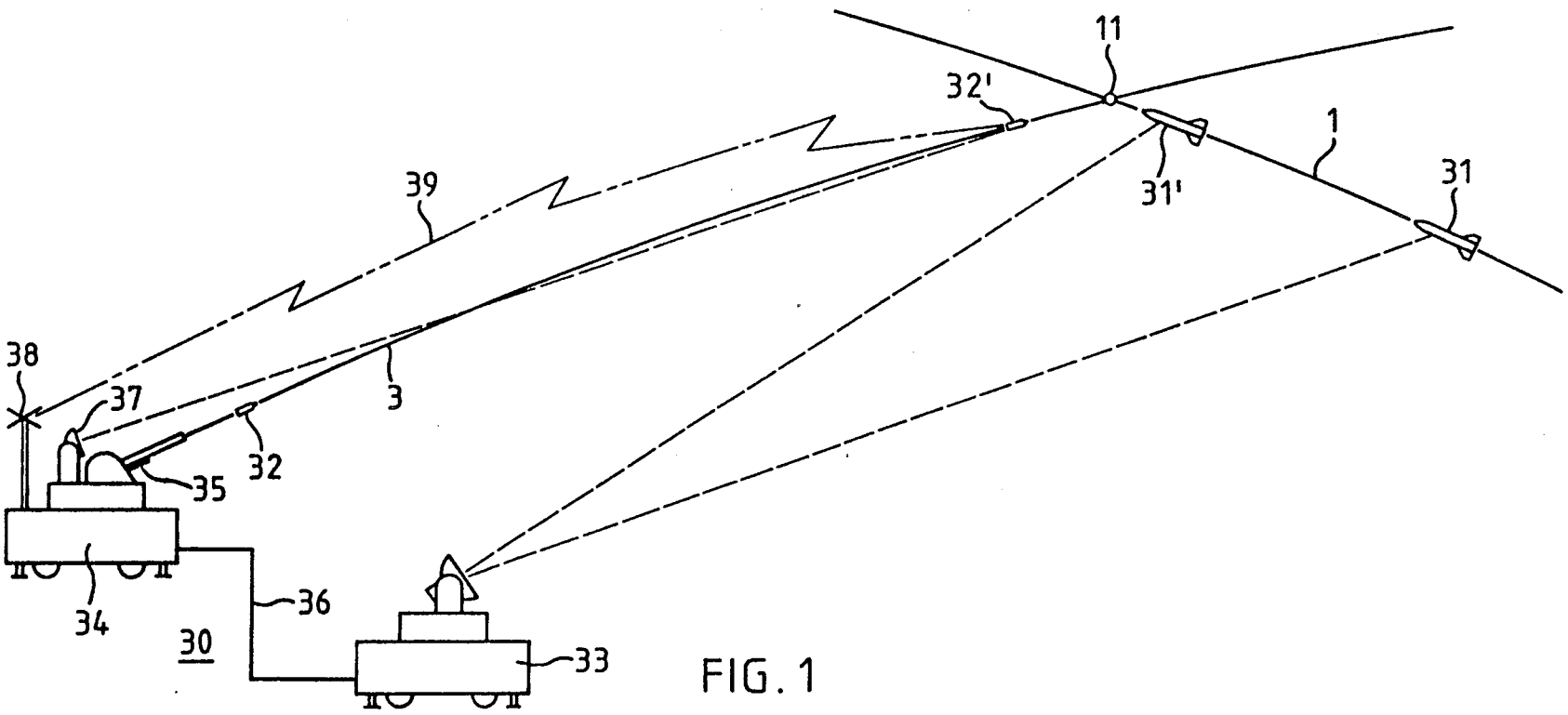
FIG. 1 is a schematic complete illustration of a missile defense installation.

Turning attention now to the drawings, which illustrate merely exemplary embodiments of the present invention, and initially to FIG. 1, the basis of the invention is an installation 30 for defense against missiles 31 by means of projectiles 32, with at least one fire control device 33 and at least one launcher 34, of the type substantially shown in FIG. 1. The basic intent is to score a direct hit on the missile 31 with the projectile 32 launched from the gun 35. The fire control device 33 continuously tracks the target, i.e., the trajectory 1 of the missile 31. Together with the knowledge of the type of missile 31 and thus its ability to maneuver, the probable trajectory 1 of the target is determined from this. On the other hand, the ballistics of the projectile 32 used in connection with the gun 35 is known. In this way it is possible to determine the trajectory 3 of the projectile 32 for a given launching direction. It can be determined furthermore at what time and in which direction the projectile 32 must be launched so that the target trajectory 1 and the projectile trajectory 3 intersect and that not only the projectile 32' but also the target 31' are simultaneously present at this intersecting point 11.

Usually the gun 35 is continuously aimed by the automatic fire control in such a way that a projectile 32 can be launched at any time, which then takes up the desired trajectory. For this purpose the fire control device 33 and the launcher 34 are combined into one system or are connected with each other via required electrical and/or communication lines 36.

Figure 2:
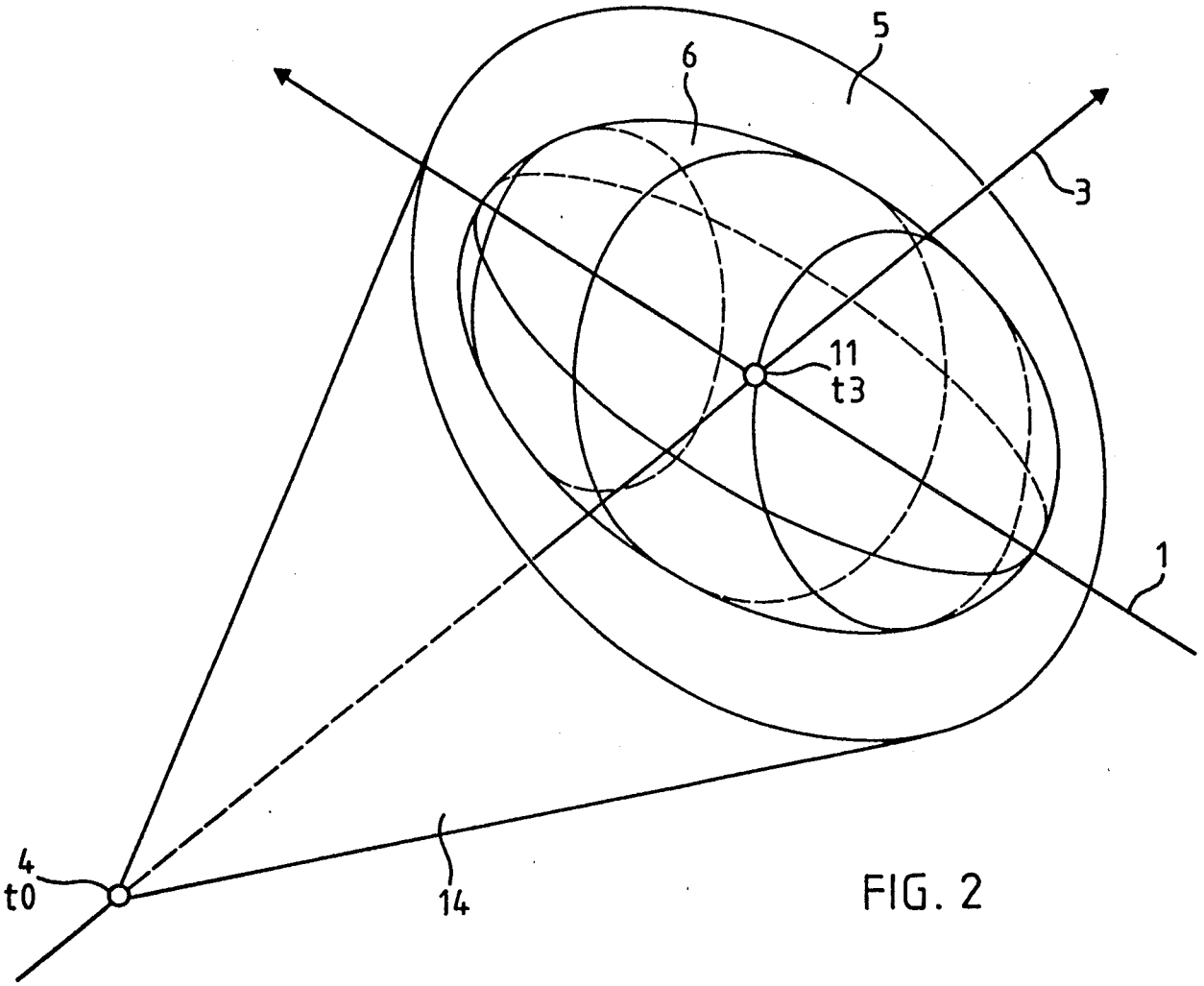
FIG. 2 is a schematic illustration, in perspective, of the conditions of missile defense by means of a time-imprinted projectile (state of the art)

The known ideal case of successful air defense is sketched in FIG. 2. The calculated target trajectory 1 is symbolized by a directional straight line, the calculated projectile trajectory 3 by another of the same kind. The two tracks intersect at the impact point 11, where in accordance with calculations the target and the projectile should meet at impact time t3. This is a mixed illustration of spatial and time elements. For example, the projectile trajectory 3 indicates the points in space over which the projectile passes in the course of time. The projectile is at point 4 at time t0 and at time $t3>t0$ at impact point 11. Spatially considered, the projectile moves out of the plane of the drawing figure from the lower left towards the upper right.

Naturally, the calculations for the positions of the target and the projectile contain uncertainties. These are determined by measuring and model inaccuracies and by external interferences. Measuring errors of the sensor play a particular role in connection with the target, especially if it can be tracked for only a short time and a comparatively long projectile flight time must be calculated in, as does the type of extrapolation calculation as well as unknown maneuvers of the target after launching the projectile. In connection with the projectile, the spread of the weapon and the munitions, with the latter the initial velocity spread, the aiming errors, particularly as a result of control deviations in the servo control, and meteorological effects are of importance. The trajectories made the basis of this therefore are the trajectories which are the most likely in accordance with the calculation model. There is a probability distribution of the actual position of the target or the projectile for every point on the trajectory, which herein will be called an "uncertainty volume" for short.

An uncertainty volume 6 has been sketched as an example in FIG. 2. At the time t3, when the target is most likely located in the impact point 11, there is an area of space (not illustrated), in which the target is located with a certainty bordering on 1, i.e., 100% certainty. At the same time a volume of space (not illustrated) can be indicated, within which the projectile is located with a certainty bordering on 1. Superimposition of the two areas results in the sketched uncertainty volume 6 around the common point 11, the shape of which is shown here in the form of a model. The proportion of target inaccuracy is considerably preponderant. It can be easily seen that there is a considerable probability that the projectile will miss the target.

Time-imprinting of the projectile is an option for ensuring a hit. FIG. 2 shows the corresponding conditions. The launch or fragmentation time t0 is located ahead in time of the calculated impact time t3. At the time t0, the projectile is located at the fragmentation point 4. Following fragmentation, the fragments of the projectile spread out in the shape of a cone. This cone 14 is suggested in FIG. 2—it opens in the direction of the observer. The tip of the cone 14 is located at the position of the projectile at fragmentation, the axis extends in the direction of movement of the projectile and the opening angle and density distribution of the fragments are characteristic of the projectile; typically, the density decreases towards the exterior.

At the time t3 the fragments are substantially distributed in a circularly limited plane and form a fragment disk 5. The plane is located orthogonally to the projectile trajectory 3 and contains the calculated impact point 11. In the ideal case, the radius of the fragment disk spread is just about large enough that the largest extent of the uncertainty volume 6 is contained therein. Knowing the projectile characteristics, i.e., the opening angle of the cone, the lead time, i.e., the time difference t3–t0, by which the projectile is fragmented prior to the calculated impact time t3 is advantageously selected in such a way that at the time t3 the fragment disk 5 has the size of the uncertainty volume 6. For long projectile travel times the uncertainty volume 6 is clearly larger than for short ones. In this case the advantage of time-imprinting only becomes apparent at the time of launching when the conditions are known. The lead time can then be adjusted to the actual situation.

Thus, the probability of a hit can be considerably increased by means of the time-imprinting method. However, the probability of success does not increase to the same extent. The fragment density decreases quadratically with increasing lead times or increasing radius of the fragment disk 5. But the probability of destruction also decreases with the density. This is basically true at a given total weight, regardless of optimization of the number of fragments and the fragment weight.

An improvement in this respect can be attained if the target is continued to be tracked during flight of the projectile and time-imprinting is performed only in flight. German Patent Publication No. 2,348,365 teaches by way of example how this can be accomplished. The required data are transmitted to the projectile 32' with the aid of a radio connection, symbolically indicated in FIG. 1 by the antenna 38 and the radio signal 39. Due to the continued tracking and calculation of the target trajectory, a command giving a corrected impact point is already possible at the time of time-imprinting, and the uncertainty volume for the position of the target is then generally smaller. FIG. 2 remains valid without change for the case of an almost unchanged calculated impact point even at the time of in-flight time-imprinting, but a different scale now applies in comparison with the former case. Due to continued tracking, the uncertainty volume 6 is smaller in extent (and somewhat changes in shape) and the distance of the fragmentation point 4 from the calculated impact point 11 is less. The density of the fragment disk 5 is correspondingly higher. Thus it is possible, with approximately unchanged probability of a hit, to increase the probability of destruction and thus the probability of success, provided that the projectile is "on the right track".

But if continued tracking results in a corrected impact point, which comes to rest at the edge of the original uncertainty volume, nothing more can be done than to select a lead time of comparatively the same size as at the time-imprinting at launching, so that a hit becomes possible at all. Although it is possible to maintain the probability of a hit, the probability of success is not increased. In other words, if the impact point has been calculated and the projectile launched accordingly, it is possible to determine the expected location of the target in the vicinity of the theoretical impact point with increasing accuracy by continued tracking, but the opportunities to react to this with the projectile are very limited. Only if the additional information indicates an advantageous constellation between the projectile and the target is it possible to select a smaller lead time, because of which the fragment density at collision and thus the probability of destruction is increased.

The invention now provides help here. The additional information is used to increase, with approximately unchanged probability of a hit, the probability of destruction in any case in comparison with the method utilizing the in-flight time-impressed fragmentation projectile, and in this way to improve the probability of success. A projectile is used for this purpose, which can also be time-impressed in flight by the fire control system or preferably remotely fragmented, but the fragments of which spread in the shape of an envelope of a cone after fragmentation. Thus the destructive potential in the form of kinetic energy in the fragments is concentrated into a widening ring.

Figure 3:
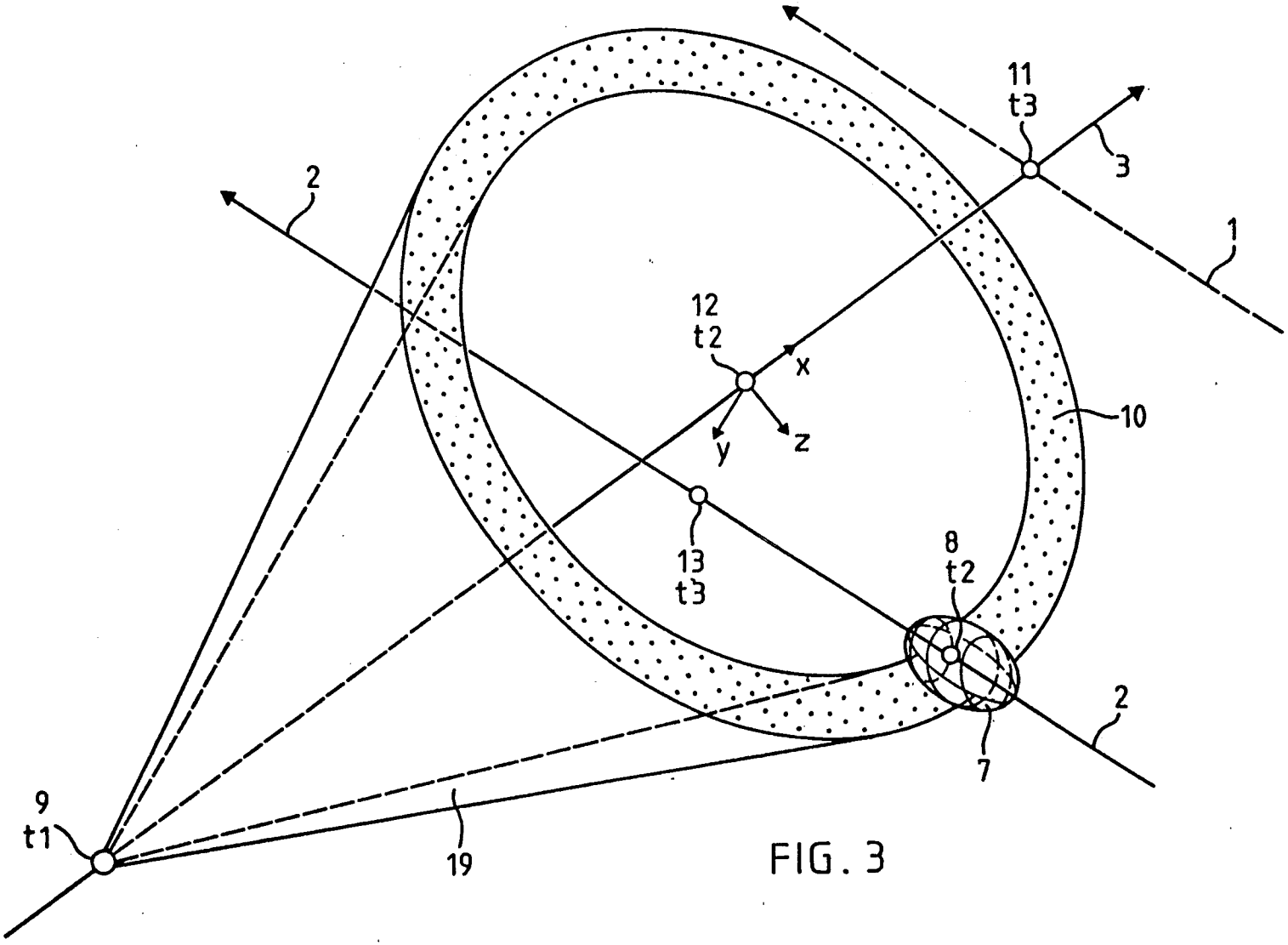
FIG. 3 is a schematic illustration of the same conditions for the method of the invention.

FIG. 3 shows in the same way as FIG. 2, in a mixed illustration of spatial and temporal elements, the conditions following fragmentation of such a conical envelope projectile. The projectile is at the fragmentation point 9 at the time t1. From then on the fragments of the projectile continue to fly through space with approximately the same axial velocity and in the course of this they all spread out in all directions with approximately the same radial velocity value. In this way, with continuing time the fragments pass through a conical envelope 19 of finite size in space, such as has been sketched in FIG. 3. The observer looks into the narrowing funnel. The calculated projectile trajectory 3, again indicated by a straight line, forms the axis of the cone, the fragmentation point 9 constitutes the apex. At the time t2 the projectile would have been at point 12 on the trajectory 3. FIG. 3 shows, additionally, the fragmentation of the projectile, a circular fragment ring 10 located approximately in the orthogonal plane with respect to trajectory 3 through the point 12, at the time t2. It can easily be seen that the fragment density in ring 10 is considerably higher than the density in connection with the distribution of the same number of fragments over the entire circular area.

FIG. 3 furthermore shows the conditions for successful air defense in accordance with the method of the invention. The target trajectory 1, calculated at the time of launching of the projectile, intersects the projectile trajectory 3 in the previously pre-calculated impact point 11 at the theoretical impact time t3. It is possible to determine the expected target trajectory around the time t3 more accurately with the aid of continued target tracking during the flight time of the projectile, but before the projectile has reached the point 9. This has been indicated as the corrected target trajectory 2. At the time t2, the relationship $t2<t3$ applies in the drawing figure, but this is not mandatory—the target is very probably at the point 8. The location of the target is known at the time t2, except for the uncertainty volume 7, which in general is considerably smaller than the uncertainty volume 6 indicated in FIG. 2 for the location of the target around the theoretical impact point 11 at the time t3, which is fixed at the time of launching of the projectile. The position 13 of the target at the time t3 following updated calculation is of course located within the uncertainty volume 6.

It should again be noted here that the above comments are relative statements regarding a projectile trajectory considered to be fixed. In absolute space the projectile trajectory will also be differently located than had been pre-calculated. It also contains uncertainties. However, these have been combined with those of the target into an uncertainty volume of the target with respect to a determined projectile trajectory. Possibly detected deviations of the actual projectile trajectory from the one pre-calculated, for example based in particular on projectile deviation measurements, are calculated in a reduced uncertainty volume of the target. Furthermore, the ballistic effects are neglected for the calculations in the immediate vicinity of the impact point, and the movements of the projectile and the fragments are considered to be substantially in a straight line and at the same velocity. These foregoing considerations will be maintained in following description.

The most important projectile deviation measurement is that of the initial velocity, which has a considerable effect on the projectile trajectory. In addition, with servo-controlled launchers the aiming errors as a result of control deviations can be easily measured and used for determining the uncertainty volume.

In connection with a particular embodiment of the method the installation is furthermore complemented by a tracking and measuring device 37 (FIG. 1) for the launched projectiles. This is advantageously placed on the launcher, but can also be combined with the fire control device 33. By means of this it is also possible to determine the expected location of each individual projectile 32' at the pre-calculated impact time continuously with greater accuracy, which contributes to a further reduction in the size of the uncertainty volume.

As shown in FIG. 3, at the time t2 the target is located within the uncertainty volume 7 around the point 8, which in turn is located in the center of the wall thickness of the fragment ring 10. This is the hit situation, where the projectile was fragmented at the time t1, so that the fragment ring 10 meets the target at the time t2. Due to the relatively large fragment density, the probability of destruction is great with a hit of this type.

There is an essential difference here in comparison with the conventional projectile shown in FIG. 2 which was possibly time-imprinted in flight and the fragment density of which decreases towards the exterior. Because the possibility that the target is located in the center of the uncertainty volume is greater than that it is at the exterior, the fragments are concentrated in the center, because in this way there is the greatest chance of success.

Figure 4:
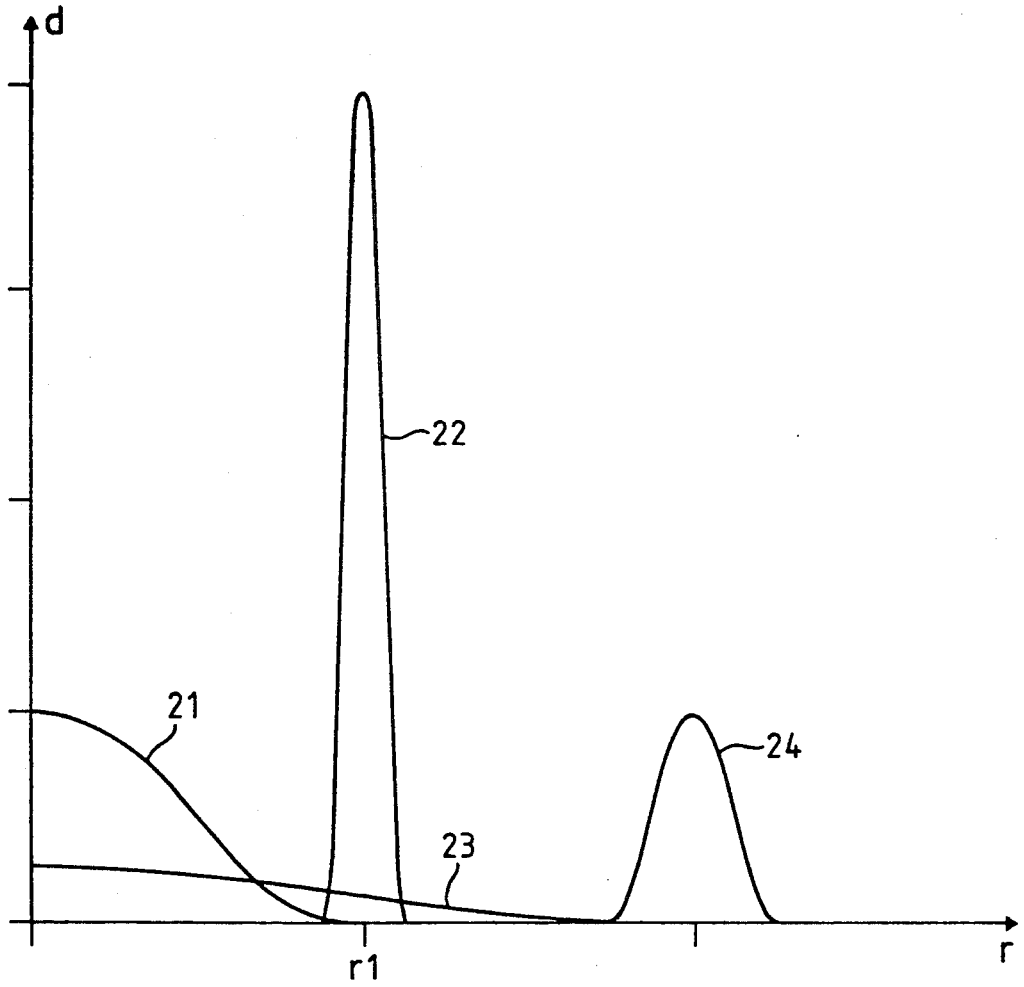
FIG. 4 shows the different distributions of the densities of two projectiles at two different times.

FIG. 4 shows the different fragment densities d for the two types of projectiles at two different times plotted over the radius r. The curve 21 shows a possible density distribution of the conventional fragmentation projectile at a defined time $T1=rl/vr$ after fragmentation, the curve 22 shows that of the conical envelope projectile at the same time. In both cases, density decreases quadratically with time, because the fixed number of fragments is distributed over a surface which expands quadratically with time, since the radius of the circular surface increases linearly with time. The curve 23 shows the conditions for the conventional fragmentation projectile at the time $2 \cdot T1$ after fragmentation, the curve 24 that of the conical envelope projectile.

It should be remembered that the recited method is primarily used to defend against missiles. Missiles have small sizes. Target surfaces of 700 square centimeters and less are not rare. Thus, with too low a fragment density there is the danger that no hit at all is scored or that hits by a few very small fragments are not sufficient to render the missile harmless.

It will now be shown by means of the following description that with the described method it is always possible to cause the meeting of the fragment ring and the expected position of the target, so that a hit will be scored with a high degree of probability where, due to the relatively high fragment density, success is also very probable. A simplified way of looking at this is used, which is based on linear equations. When employing the invention, one skilled in the art can make use of a detailed model for increasing accuracy. A cartesian coordinate system is made the basis of the calculations, the directions of the axes of which are defined as follows: x-axis in the direction of the projectile trajectory 3, y-axis horizontally in the orthogonal plane thereto; thus the z-axis has the direction of the sectional straight line between a vertical plane through the projectile trajectory and the orthogonal plane in respect to the projectile trajectory. The axial directions are shown in FIG. 3 at the point 12. The projectile moves at the velocity $vg>0$ along the x-axis, the fragments additionally having a radial component vr. The ratio vr/vg determines the opening angle of the cone. At the time $t>t1$, all the fragments have the x-coordinate xg(t) and the distance $r(t)=vr\cdot(t-t1)$ from the projectile trajectory 3. The present target location p(t) is indicated by the components xf(t), yf(t) and zf(t) and the target velocity by the components vfx, vfy and vfz. It does not make a difference where on the cone axis, i.e., the projectile trajectory 3, the origin of the coordinate system is selected to be placed.

Based on continuous tracking, the target location 13 at the time t3, p(t3) is known. What is sought is the fragmentation time t1 so that, at the yet unknown corrected impact time t2, the fragment ring 10 includes the location 8 of the target, p(t2). A first condition arises from this, where the x-coordinates of projectile fragments and the target must be the same, i.e., $xf(tz)=xg(t2)$. The also yet unknown difference between the corrected impact time t2 and the previously calculated impact time t3 is designated by T: $T=t2-t3$. T can be positive or negative, obviously T is negative in FIG. 3. Therefore:

$$xf(t2)=xf(t3)+vfx\cdot T \text{ and } xg(t2)=xg(t3)+vg\cdot T$$

applies, from which $$T=\frac{xf(t3)-xg(t3)}{vg-vfx}$$

directly results.

The equation always has a solution which results with satisfactory approximation in a value for the correction T of the impact time. It can be assumed that the only sensible prerequisite has been met, where $vg>vfx$, i.e., that the target does not move faster in the direction of the projectile as the projectile itself; in the normal case $vfx<0$ even applies. The local amount of deviation $xf(t3)-xg(t3)$, which in FIG. 3 is the x-component of the distance of the point 13 from the point 11, is limited by the original uncertainty volume 6. Thus T can always be determined and is sufficiently small.

With T and $t2=t3+T$ now known, the distance a(t2) of the target from the projectile trajectory 3 or the cone axis results from the root of the square sum of $$yf(t2)=yf(t3)+vfy\cdot T \text{ and } zf(t2)=zf(t3)+vfy\cdot T:$$

$$a(t2)=\sqrt{[yf(t2)\cdot yf(t2)+zf(t2)\cdot zf(t2)]}.$$

As the second hit condition, the fragment ring radius must equal the distance of the target from the projectile trajectory, i.e., the condition $r(t2)=a(t2)$ must be met, where $r(t2)=vr\cdot(t2-t1)=vr\cdot(t3+T-t1)$ applies.

From this the sought fragmentation time t1 results as $$t1=t3+T-\frac{a(t2)}{vr}.$$

The values of a(t2) and vr are positive. t1 also is in any case smaller than $t2=t3+T$, that means, the desired solution exists.

For practical use a certain scatter would be provided for the radial velocity vr of the fragments, so that the fragment ring 10 is given a finite Width. The remaining reduced uncertainty volume 7 is taken into account by means of this.

Thus the method in accordance with the invention assures a high degree of hit probability, combined with a high concentration of the fragments of the projectile and in this way assures a high degree of probability of success.

It is of course also possible to apply the method for combatting other moving targets, namely defense against aircraft and battle helicopters. Knowing the invention, one skilled in the art is easily capable of performing the necessary adaptations to the characteristics of the intended use.

This application is based upon Swiss Application No. 03 755/91-5, filed on Dec. 18, 1991, the priority of which is claimed and the disclosure of which is hereby expressly incorporated by reference thereto in its entirety.

Finally, although the invention has been described with reference of particular means, materials and embodiments, it is to be understood that the invention is not limited to the particulars disclosed and extends to all equivalents within the scope of the claims.

What is claimed is:

1. A method for increasing the probability of success in defense against a movable target by means of a remotely fragmentable projectile launched from a weapons system including a fire control device, a launcher with means for individually setting a projectile at launch and selecting during flight of the projectile, a fragmentation point for the projectile, said method comprising the steps of:

launching the projectile for impact with the target;

determining a position of the target at an expected time of impact by tracking the target by means of the fire control device;

fragmenting the projectile to cause fragments to move apart in the shape of a conical envelope with approximately equal radial velocity in a widening fragment ring at a selected time; and selecting the time at which the projectile is to be fragmented to result in a spatial and temporal meeting of the target at a point in the fragment ring.

2. A method in accordance with claim 1, further comprising the step of:

measuring launching values of the launching direction at the time of launching of the projectile, from which the expected position of the projectile at the expected time of impact is more accurately determined and is included in the step of selecting the time of fragmentation of the projectile.

3. A method in accordance with claim 2, further comprising the step of:

measuring as a launching value the initial velocity of the projectile and including the launching value in the step of selecting the time of fragmentation of the projectile.

4. A method in accordance with claim 1, further comprising the step of:

tracking the projectile in flight after the step of launching the projectile, thereby the position and expected time in the step of determining the position of the target at an expected time of impact are increasingly more accurately determined.

* * * * *